US005948045A

United States Patent [19]

Reiner

[11] Patent Number: 5,948,045

[45] Date of Patent: Sep. 7, 1999

[54] METHOD FOR AIRBOURNE TRANSFER ALIGNMENT OF AN INERTIAL MEASUREMENT UNIT

[75] Inventor: Jacob Reiner, Misqav, Israel

[73] Assignee: State of Israel-Ministry of Defense Armament Development Authority-Rafael, Haifa, Israel

[21] Appl. No.: 08/652,331

[22] Filed: May 22, 1996

[30] Foreign Application Priority Data

May 23, 1995 [IL] Israel ..... 113830

[51] Int. Cl.[6] ..... G06F 165/00; F41G 7/36

[52] U.S. Cl. ..... 701/220; 701/4; 701/14; 244/3.2; 244/177

[58] Field of Search ..... 701/3, 4, 5, 6, 701/13, 14, 220, 221; 244/3.21, 3.2, 175, 177, 181; 364/551.01, 559, 571; 73/1 E

[56] References Cited

U.S. PATENT DOCUMENTS

| | | | |
|---|---|---|---|
| 4,032,759 | 6/1977 | Danik | 701/220 |
| 4,444,086 | 4/1984 | White | 89/1.8 |
| 4,495,850 | 1/1985 | White | 244/3.1 |
| 5,031,330 | 7/1991 | Stuart | 33/366 |
| 5,150,856 | 9/1992 | Gaide | 244/3.2 |
| 5,274,236 | 12/1993 | Pascale et al. | 244/3.16 |
| 5,587,904 | 12/1996 | Ben-Yair et al. | 701/213 |

*Primary Examiner*—Tan Q. Nguyen
*Attorney, Agent, or Firm*—Darby & Darby

[57] ABSTRACT

A method for determining the initial conditions for an inertial measurement unit (IMU) of a second vehicle launched from a wing of a first vehicle is provided. The method includes the steps of defining a state vector x as including (a) the rotation $\zeta$ of the computed coordinate axes with respect to the real coordinate axes of the second vehicle and (b) the projection $\delta\alpha$ along the Z axis of the first vehicle of the rotation of the second vehicle from its nominal coordinate axes to its real coordinate axes. A measurement z is defined as the projection $\delta\beta$ of a rotation angle $\beta$, along the Z axis of the first vehicle, between the nominal coordinate axes and a current computed coordinate axes. The method also includes the steps of estimating x over time with a Kalman filter, wherein the projection $\delta\beta$ is the measurement vector and the state vector x changes only due to random noise and processing x to produce the attitude about the Z axis of the first vehicle.

4 Claims, 2 Drawing Sheets

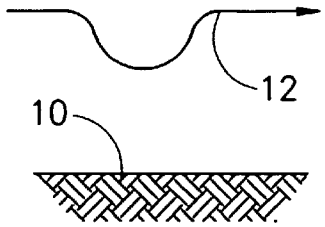
FIG. 1
PRIOR ART
FIG.2
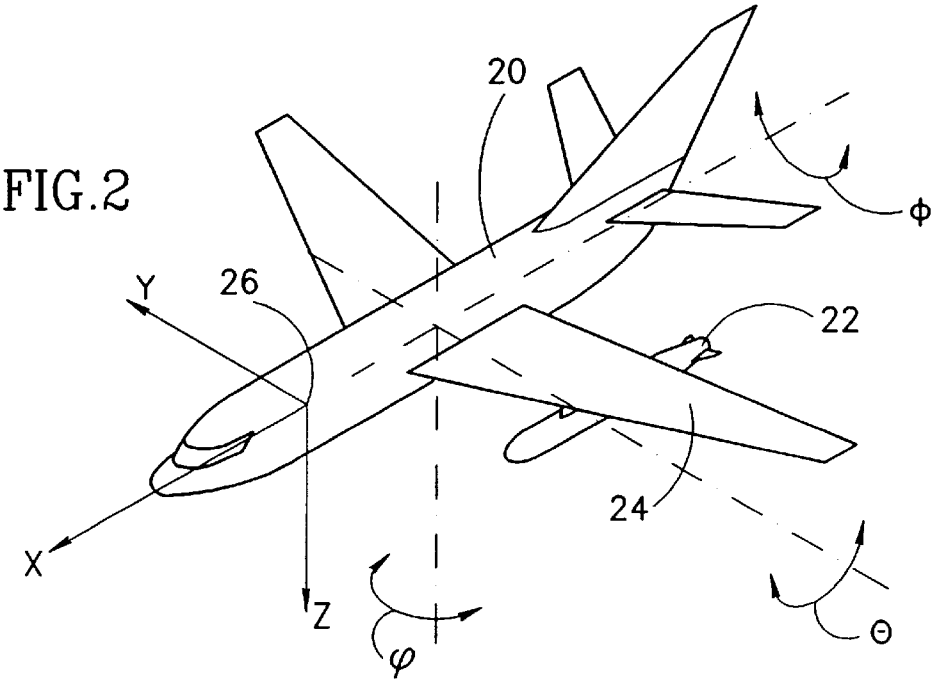
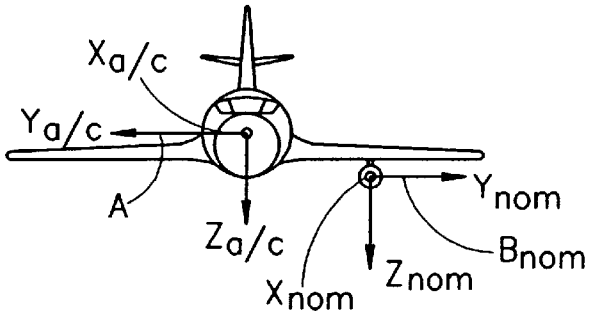
FIG.3A
FIG.3B
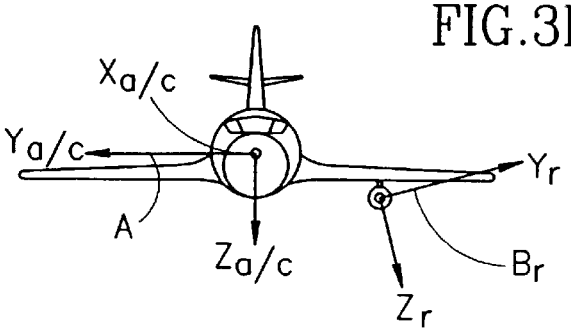

METHOD FOR AIRBOURNE TRANSFER ALIGNMENT OF AN INERTIAL MEASUREMENT UNIT

FIELD OF THE INVENTION

The present invention relates to in-flight alignment of inertial measurement units (IMUs) generally and, in particular, to alignment of an IMU of a second vehicle which is attached to a first vehicle.

BACKGROUND OF THE INVENTION

Airplanes often carry with them other flying vehicles, such as smaller airplanes or missiles, which are to be launched during flight. The second vehicle typically is located on the wing of the first vehicle. Both vehicles have inertial measurement units (IMUs) on them for determining their inertial locations.

In order to operate, IMUs require to know the initial position, velocity and attitude of the vehicle with respect to some predefined coordinate system.

During flight, the navigation system of the main vehicle continually operates to determine the attitude, velocity and position of the vehicle. Before the second vehicle is launched, the main vehicle provides the initial conditions to the IMUs of the second vehicle. As long as the exact position, velocity and attitude of the second vehicle with respect to the main vehicle are known and as long as the current values are accurate, the second vehicle will receive an accurate set of initial conditions.

However, the output of the IMU on the second vehicle tends to drift (i.e. lose accuracy) over time and, more importantly, due to vibrations in flight, the second vehicle might rotate from its nominal position. If the extent of the rotation is not compensated, the IMU output of the second vehicle will not be reliable.

The rotation can be estimated by performing a maneuver which excites lateral acceleration. The output of both sets of IMUs are compared and the angle of rotation of the second vehicle vis-a-vis the main vehicle is determined.

Pitch and roll angles are not difficult to estimate. However, the standard maneuver for yaw estimation, illustrated in FIG. 1 to which reference is now made, requires curving in and out along a curve 12, horizontal to the ground 10. Pilots generally do not like to perform such a maneuver just prior to releasing the second vehicle. However, without it, the navigation system of the second vehicle is not properly calibrated.

SUMMARY OF THE PRESENT INVENTION

Applicant has realized that, for second vehicles attached onto the wings of the main vehicle, the rotation of the second vehicle is typically caused by movement of the wings. Applicant has further realized that the wings can flap up and down (pitch) and can rotate about their main axis (roll) but they cannot rotate around the vertical (Z) axis simply due to how the wings are built. In other words, the yaw angle of the wings does not change.

Therefore, the yaw calibration flight maneuver can be performed at any time during the flight, to determine the yaw rotation as measured by the IMU of the second vehicle. Since the second vehicle does not rotate in the yaw direction, any difference from the output of the IMU of the first vehicle is due to drift only. The pitch and roll information is updated without any specific maneuvers.

It is therefore an object of the present invention to provide a method for determining initial conditions, in the yaw direction, for the IMU of the second vehicle.

In accordance with the present invention, there is provided a method for determining the initial conditions for an inertial measurement unit (IMU) of a second vehicle to be launched from a wing of a first vehicle. The method includes the steps of defining a state vector x as including (a) the rotation $\zeta$ of the computed coordinate axes with respect to the real coordinate axes of the second vehicle and (b) the projection $\delta\alpha$ along the Z axis of the first vehicle of the rotation of the second vehicle from its nominal coordinate axes to its real coordinate axes. A measurement z is defined as the projection $\delta\beta$ of a rotation angle $\beta$, along the Z axis of the first vehicle, between the nominal coordinate axes and a current computed coordinate axes. The method also includes the steps of estimating x over time with a Kalman filter, wherein the projection $\delta\beta$ is the measurement vector and the state vector x changes only due to random noise and processing x to produce the attitude about the Z axis of the first vehicle.

Furthermore, in accordance with the present invention, the projection $\delta\beta$ of angle $\beta$ is determined from the following measurements:

a. the quaternion $q_{L:A}$ representing the relative attitude from the LLLN axes to the main airplane A axes;

b. the quaternion $q_{A:NOM}$ representing the relative attitude from the main airplane A axes to the nominal, second vehicle axes $B_{NOM}$;

c. the quaternion $q_{L:C}$ representing the relative attitude from the LLLN axes to the computed second vehicle axes $B_C$;

d. the direction cosine matrix $C_{NOM:A}$ defining the rotation from $B_{NOM}$ to the main airplane axes A; and e. the direction cosine matrix $C_{L:A}$ defining the rotation from LLLN to the main airplane axes A.

Furthermore, in accordance with the present invention, the step of Kalman filtering utilizes the following measurement equation:

$$z = \left[C_{L:A}(3,1),\ C_{L:A}(3{:}2),\ C_{L:A}(3,3) - 1\right] \cdot \begin{vmatrix} \zeta_x \\ \zeta_y \\ \zeta_z \\ \delta\alpha \end{vmatrix}$$

Additionally, in accordance with the present invention, there is provided a method for determining the initial conditions for an inertial measurement unit (IMU) of a second vehicle to be launched from a wing of a first vehicle which utilizes the fact that the wing has no rotation about the Z axis of the first vehicle, and therefore, the second vehicle does not rotate about the Z axis of the first vehicle.

BRIEF DESCRIPTION OF THE DRAWINGS

The present invention will be understood and appreciated more fully from the following detailed description taken in conjunction with the drawings in which:

FIG. 1 is a schematic illustration of a prior art yaw maneuver;

FIG. 2 is a schematic illustration of a main airplane with a second vehicle attached thereto, useful in understanding the present invention;

FIG. 3A is a schematic illustration of the coordinate axes of the main airplane and the nominal axes of the second vehicle of FIG. 2;

FIG. 3B is a schematic illustration of the coordinate axes of the main airplane and the actual axes of the second vehicle of FIG. 2;

DETAILED DESCRIPTION OF A PREFERRED EMBODIMENT

Figure 4A:
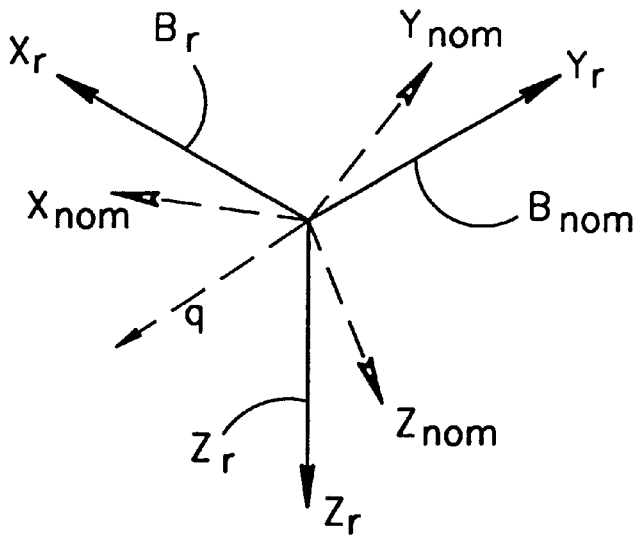
FIG. 4A is a schematic illustration of the rotation from the nominal to the actual axes of the second vehicle.

Reference is now made to FIGS. 2, 3A, 3B, 4A, 4B and 5 which are useful in understanding the present invention.

FIG. 2 illustrates a main airplane 20 having a second vehicle 22 attached to its wing 24. Shown also are the coordinate system 26 of the main airplane 20 and the rotation angles pitch $\theta$, roll $\phi$ and yaw $\psi$, where pitch $\theta$ is a rotation about the Y axis, roll $\phi$ is a rotation about the X axis and yaw $\psi$ is a rotation about the Z axis.

Applicant has realized that the rotation of the second vehicle is typically caused by movement of the wings. Applicant has further realized that the wings can flap up and down (pitch) and can rotate about their main axis (roll) but they cannot rotate around the vertical (Z) axis simply due to how the wings are built. In other words, during flight, the yaw angle of the wings does not change.

The present invention is a system for determining the initial conditions of the IMU of the second vehicle and it utilizes the fact that, physically, there is no yaw rotation. In the present invention, the pilot needs to perform the yaw maneuver only once, at any point during his flight, to determine the yaw angle of the second vehicle 22 vis-a-vis the main vehicle 20. Since the wing does not yaw, there should be no changes in the yaw angle measured by the IMUs of the second vehicle 22 after the yaw maneuver is performed. The present invention constantly measures any drift in the yaw angle determined by the IMU. The roll and pitch initial values are taken in the same manner as in the prior art.

FIG. 3A illustrates the coordinate axes A of the main vehicle 20 and $B_{NOM}$ of the nominal attitude of second vehicle 22 prior to calibration. FIG. 3B illustrates the coordinate axes A of the main vehicle 20 and the real axes $B_R$ of the second vehicle 22 during flight. The coordinate axes A of the main vehicle 20 are known since its navigation system is accurate. The nominal axes $B_{NOM}$ of the second vehicle 22 are known since they are nominally known prior to flight. The real axes $B_R$ of the second vehicle 22 are to be found.

There is a fourth set of axes $B_C$ (not shown) which is the computed set. It is rotated from the real axes $B_R$ by a vector $\zeta=[\zeta_x,\zeta_y,\zeta_z]$ (not shown) given in local level local north (LLLN) axes.

Figure 4B:
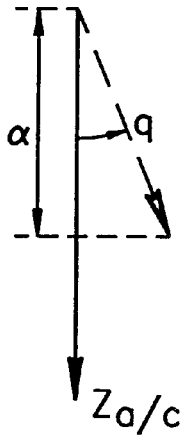
FIG. 4B is a schematic illustration of the projection of the rotation quaternion which describes the rotation of FIG. 4A onto the Z axis of the main airplane.

As can be seen in FIG. 4A, the actual coordinate axes $B_R$ are rotated from the nominal, coordinate axes $B_{NOM}$ by an amount q which is a quaternion. The rotation of the second vehicle 22 about the Z axis of the main airplane 20 is represented by the projection $\alpha$ of the quaternion q along the Z axis, $Z_{a/c}$, of the main vehicle 20. "$\alpha$" is illustrated in FIG. 4B.

Figure 5:
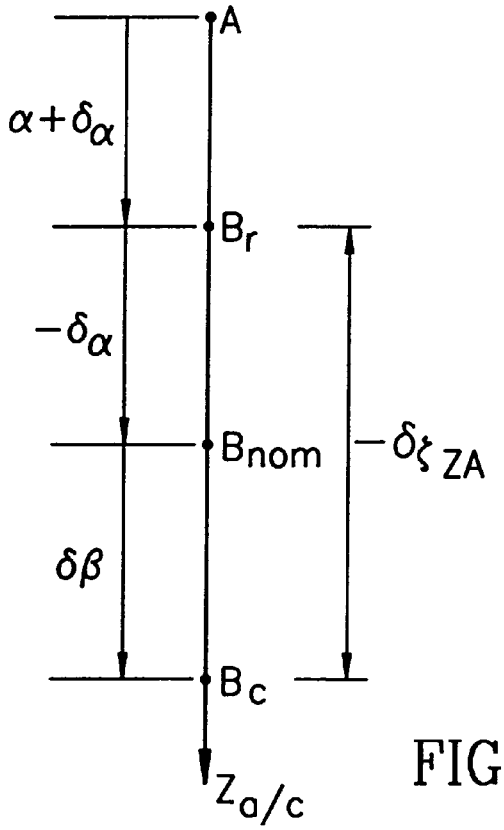
FIG. 5 is a schematic illustration showing the relationships of four coordinate axes, that of the main airplane and the nominal, actual and computed axes of the second vehicle.

FIG. 5 illustrates the relationship among the four different coordinate axes where the arrows indicate the positive directions. The main airplane axes A and the nominal second vehicle IMU axes $B_{NOM}$ are rotated from each other by the measured angle $\alpha$ and the angle from the main airplane axes A to the real second vehicle IMU axes $B_R$ is $(\alpha+\delta\alpha)$ where $\delta\alpha$ is unknown. The computed axes $B_c$ are rotated from the nominal axes $B_{NOM}$ by an angle $\delta\beta$.

The angle from $B_R$ to $B_c$ is defined as $-\delta\zeta_{ZA}$ which is the projection of the vector $\zeta=[\zeta_x,\zeta_y,\zeta_z]$ onto the $Z_{a/c}$ axis.

In accordance with a preferred embodiment of the present invention, the angle of the second vehicle 22 vis-a-vis the main vehicle 20 might not be the same as the value ($\alpha$) given prior to flight. The difference, along the Z axis of the main airplane, is noted $\delta\alpha$ and is a fixed value. $\delta\alpha$ is estimated with an extended Kalman Filter as are the computed angles, $\zeta_x$, $\zeta_y$ and $\zeta_z$, between the computed second vehicle IMU axes and the real axes. If the state vector is:

$$\underline{X} = \begin{vmatrix} \zeta_x \\ \zeta_y \\ \zeta_z \\ \delta\alpha \end{vmatrix} \tag{1}$$

the continuous system model is given by:

$$\dot{\underline{X}}=A\underline{x}+\underline{w} \tag{2}$$

$$A=[0] \tag{3}$$

where [0] is a 4×4 matrix full of zeros and $\underline{w}$ is a four element, normal, distributed, zero mean, white noise vector. In other words, the states change only because of random noise.

The measurement model for the extended Kalman Filter is given by:

$$z=H\underline{x}+v \tag{4}$$

where z and H are as defined hereinbelow and v is a normal, distributed, zero mean, white noise element.

The following measurement information is available:

1) the quaternion $q_{L:A}$ representing the relative attitude from the LLLN axes to the main airplane A axes;
2) the quaternion $q_{A:NOM}$ representing the relative attitude from the main airplane A axes to the nominal, second vehicle axes $B_{NOM}$;
3) the quaternion $q_{L:C}$ representing the relative attitude from the LLLN axes to the computed second vehicle axes $B_C$;
4) the direction cosine matrix $C_{NOM:A}$ defining the rotation from $B_{NOM}$ to the main airplane axes A; and
5) the direction cosine matrix $C_{L:A}$ defining the rotation from LLLN to the main airplane axes A.

Quaternion mathematics produces:

$$q_{L:NOM}=q_{L:A}{}^{*}q_{A:NOM} \tag{5}$$

$$q_{C:NOM}=q_{C:L}{}^{*}q_{L:A}{}^{*}q_{A:NOM} \tag{6}$$

The attitude error from axes $B_C$ to axes $B_{NOM}$ is typically small and is given, in $B_{NOM}$ axes, as:

$$\beta_x=2^{*}q_{C:NOM}(1) \tag{7}$$

$$\beta_y=2^{*}q_{C:NOM}(2) \tag{8}$$

$$\beta_z=2^{*}q_{C:NOM}(3) \tag{9}$$

where $q_{C:NOM}(i)$ is the ith element of the quaternion $q_{C:NOM}$.

The projection of $\beta_j$,j=x,y,z, onto the $Z_{a/c}$ axis is $-\delta\beta$ and is determined as follows:

$$-\delta\beta = C_{NOM:A}(3,*)\cdot\begin{vmatrix}\beta_x\\ \beta_y\\ \beta_z\end{vmatrix} \tag{10}$$

where $C_{NOM:A}(3,\cdot)$ denotes the third row of the nominal direction cosine matrix $C_{NOM:A}$. $-\delta\beta$ is a measurement. It therefore forms the measurement element z.

Referring back to FIG. 5, the following statement can be made:

$$\text{angle } (B_C \text{ to } B_R)=\delta\zeta_{ZA}=\delta\alpha-\delta\beta \tag{11}$$

or:

$$-\delta\beta=\delta\zeta_{ZA}-\delta\alpha \tag{12}$$

or $$z=H\zeta-\delta\alpha \tag{13}$$

where $H\zeta$ projects the vector $\zeta$ from the LLLN axes to the $Z_{a/c}$ axis. Now:

$$H\zeta=C_{L:A}(3,*).\zeta \tag{14}$$

Hence, the measurement of equation 13, is given by:

$$z = \left[C_{L:A}(3,1),\ C_{L:A}(3:2),\ C_{L:A}(3,3)-1\right]\cdot\begin{vmatrix}\zeta_x\\ \zeta_y\\ \zeta_z\\ \delta\alpha\end{vmatrix} \tag{15}$$

model for the Kalman filter is provided in equations 1–4 and the measurement equation is provided in equation 4, repeated hereinbelow.

$$z=Hx+v \tag{16}$$

It is noted that z is a one-dimensional element having the value of $-\delta\beta$ and the matrix H is given by:

$$H=[C_{L:A}(3,1),C_{L:A}(3,2),C_{L:A}(3,3)-1] \tag{17}$$

A priori knowledge of the aircraft operation should be utilized to determine the white noise characteristics of variables v and w.

In accordance with the present invention, a Kalman Filter using the model of equations 1–4 and 16 is implemented and estimates thereby the values for x.

It will be appreciated by persons skilled in the art that the present invention is not limited to what has been particularly shown and described hereinabove. Rather the scope of the present invention is defined by the claims which follow:

What is claimed is:

1. A method for determining the initial conditions for an inertial measurement unit (IMU) of a second vehicle to be launched from a wing of a first vehicle, wherein the second vehicle rotates from its nominal coordinate axes during flight and the initial conditions include the attitude of the second vehicle, relative to the first vehicle, about the Z axis of the first vehicle, the method comprising the steps of:

a. defining a state vector x as including (a) the rotation $\zeta$ of computed coordinate axes of the second vehicle with respect to the real coordinate axes of the second vehicle and (b) the projection $\delta\alpha$, along the Z axis of the first vehicle, of the rotation of the second vehicle from its nominal coordinate axes to its real coordinate axes;

b. determining a measurement z as the projection db of a rotation angle b, along the Z axis of the first vehicle, between the nominal coordinate axes and a current version of said computed coordinate axes, both axes being of the second vehicle;

c. estimating x over time with a Kalman filter, wherein said projection db is the measurement vector and said state vector x changes only due to random noise;

d. processing x to produce the attitude of the second vehicle relative to the first vehicle about the Z axis of said first vehicle.

2. A method according to claim 1 and wherein said projection $\delta\beta$ of angle $\beta$ is determined from the following measurements:

a. the quaternion $q_{L:A}$ representing the relative attitude from the LLLN axes to the main airplane A axes;

b. the quaternion $q_{A:NOM}$ representing the relative attitude from the main airplane A axes to the nominal, second vehicle axes $B_{NOM}$;

c. the quaternion $q_{L:C}$ representing the relative attitude from the LLLN axes to the computed second vehicle axes $B_C$;

d. the direction cosine matrix $C_{NOM:A}$ defining the rotation from $B_{NOM}$ to the main airplane axes A; and e. the direction cosine matrix $C_{L:A}$ defining the rotation from LLLN to the main airplane axes A; according to the following equation: $-\delta\beta=2*C_{NOM:A}(3,*).q_{C:NOM}$.

3. A method according to claim 2 and wherein said step of Kalman filtering utilizes the following measurement equation:

$$z = \left[C_{L:A}(3,1),\ C_{L:A}(3:2),\ C_{L:A}(3,3)-1\right]\cdot\begin{vmatrix}\zeta_x\\ \zeta_y\\ \zeta_z\\ \delta\alpha\end{vmatrix}$$

4. A method for determining the initial conditions for an inertial measurment unit (IMU) of a second vehicle to be launched from a wing of a first vehicle, wherein the second vehicle rotates from its nominal coordinate axes during flight and the initial conditions include the attitude of the second vehicle, relative to the first vehicle, about the Z axis of te first vehicle, the method comprising the step of:

defining a state vector x which includes at least a variable which models the fact that said wing has no rotation about the Z axis of the first vehicle, and therefore, the rotation of the second vehicle about the Z axis of the first vehicle does not change in flight.

* * * * *

UNITED STATES PATENT AND TRADEMARK OFFICE

CERTIFICATE OF CORRECTION

PATENT NO. :5,948,045
DATED :September 7, 1999
INVENTOR(S) :Jacob REINER

It is certified that error appears in the above-identified patent and that said Letters Patent is hereby corrected as shown below:

Title Page, [54] Title, "METHOD FOR AIRBOURNE TRANSFER ALIGNMENT OF AN INERTIAL MEASUREMENT" Should Be --METHOD FOR AIRBORNE TRANSFER ALIGNMENT OF AN INERTIAL MEASUREMENT--.

Signed and Sealed this

Ninth Day of May, 2000

*Attest:*

Q. TODD DICKINSON

*Attesting Officer*

*Director of Patents and Trademarks*